United States Patent [19]

Riley

[11] 4,185,796

[45] Jan. 29, 1980

[54] FIBER OPTIC MISSILE GUIDANCE AND CONTROL

[75] Inventor: Leon H. Riley, Huntsville, Ala.

[73] Assignee: The United States of America as represented by the Secretary of the Army, Washington, D.C.

[21] Appl. No.: 750,034

[22] Filed: Dec. 13, 1976

[51] Int. Cl. ..... F42B 15/04; F41G 7/02; F41G 7/18

[52] U.S. Cl. ..... 244/3.12

[58] Field of Search ..... 244/3.12; 350/96.1

[56] References Cited

U.S. PATENT DOCUMENTS 3,592,550 7/1971 Christman ..... 350/96.1

FOREIGN PATENT DOCUMENTS 7507590 3/1974 France ..... 244/3.12

1467552 3/1977 United Kingdom ..... 244/3.12

*Primary Examiner*—Samuel W. Engle

*Assistant Examiner*—Thomas H. Webb

*Attorney, Agent, or Firm*—Nathan Edelberg; Robert P. Gibson; Harold W. Hilton

[57] ABSTRACT

A fiber optical transmission system for guiding and controlling a missile. The fiber optic link can provide for up and down link transmission that can provide target and reference position information not available to present wire guided missile systems. Fiber optics have an almost unlimited information transfer rate and does not have the electrical interference problems of the wire systems.

2 Claims, 2 Drawing Figures

FIBER OPTIC MISSILE GUIDANCE AND CONTROL

DEDICATORY CLAUSE

The invention described herein may be manufactured, used and licensed by or for the Government for governmental purposes without the payment to me of any royalties thereon.

BACKGROUND OF THE INVENTION

This invention relates to guided missile systems. Present wire guided missiles have information transfer rates that are limited by the electrical characteristics of the transmission wire and its assembly. Wires interconnect the missile to a guidance and control (G&C) set at the launch site. These wire guided missiles employ wire bobbins in the missile that deploy wire behind the missile as the missile moves to its target. The electrical character of the bobbin and of the deployed wire limits the rate at which the system can be controlled and does not provide for transfer of target information to the G&C set from the missile. Two wires are normally required to complete the electrical guidance circuit. These wires provide an electrical interference pick up that further limits information rates.

SUMMARY OF THE INVENTION

This invention provides for the use of fiber optics to interconnect the missile and G&C. The fiber optics have an almost unlimited information transfer rate and does not have the electrical interference problems of the wire system. The information transmission bandwidth of fiber optics has been established at approximately 10'' bits/second/kilometer which is approximately 100 times greater than the best coaxial cable and approximately $10^8$ times greater than the missile wire guidance system presently used. The fiber optic link can provide for up and down link transmission that can provide target and reference position information not available to present wire guided missile systems. The fiber optic system is not as susceptible to electrical interference as the wire system since it does not utilize electrical signals through long electrical conductors. Fiber optic links can be utilized that employ fibers of approximately 0.005 diameter and a single bobbin. Present wire guided missiles utilizing wires of this approximate size are forced to use two bobbins.

This invention may be better understood from the following detailed description taken in conjunction with the accompanying drawing.

DESCRIPTION OF THE PREFERRED EMBODIMENT

Figure 1:
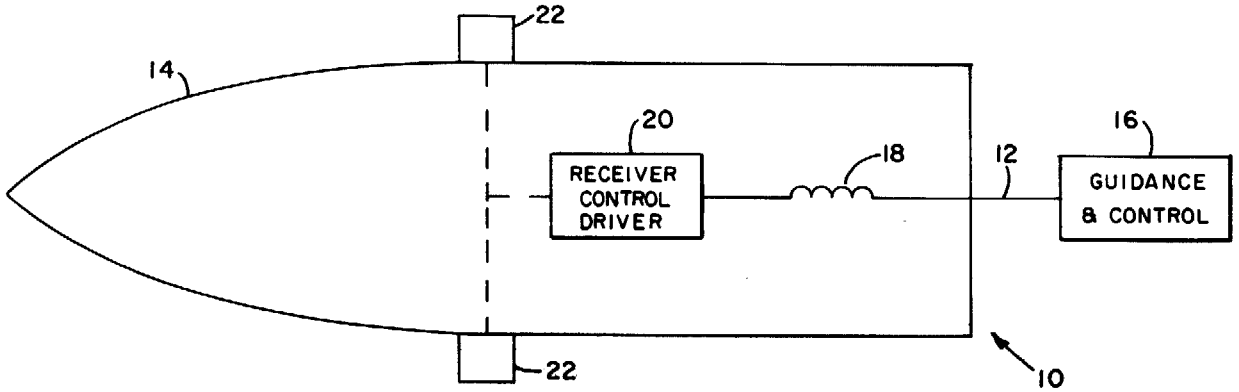
FIG. 1 is a diagrammatic view of a fiber optic guided missile.

The fiber optic system utilizes light as a transfer medium between missile and launcher guidance and control. This light is transferred through glass or plastic fibers that are not electrical conductors and do not have electrical interference introduced into the transfer medium. As seen in FIG. 1, the guided missile system generally indicated as 10 utilizes fiber optic 12 to control the missile 14 in flight. In this system the fiber optic is connected at one end to a guidance and control unit 16 that determines the flight path of the missile and transmits missile guidance information through the fiber optic to the missile. The opposite end of the fiber optic is connected through a fiber optic bobbin 18 to a receiver control driver 20 located in missile 14. The guidance information is received and processed by the driver 20 where control surface commands are developed and the command drives the control surfaces 22 which position the missile on the proper flight path. As the missile proceeds along its trajectory the fiber optic is played off the bobbin 18.

Figure 2:
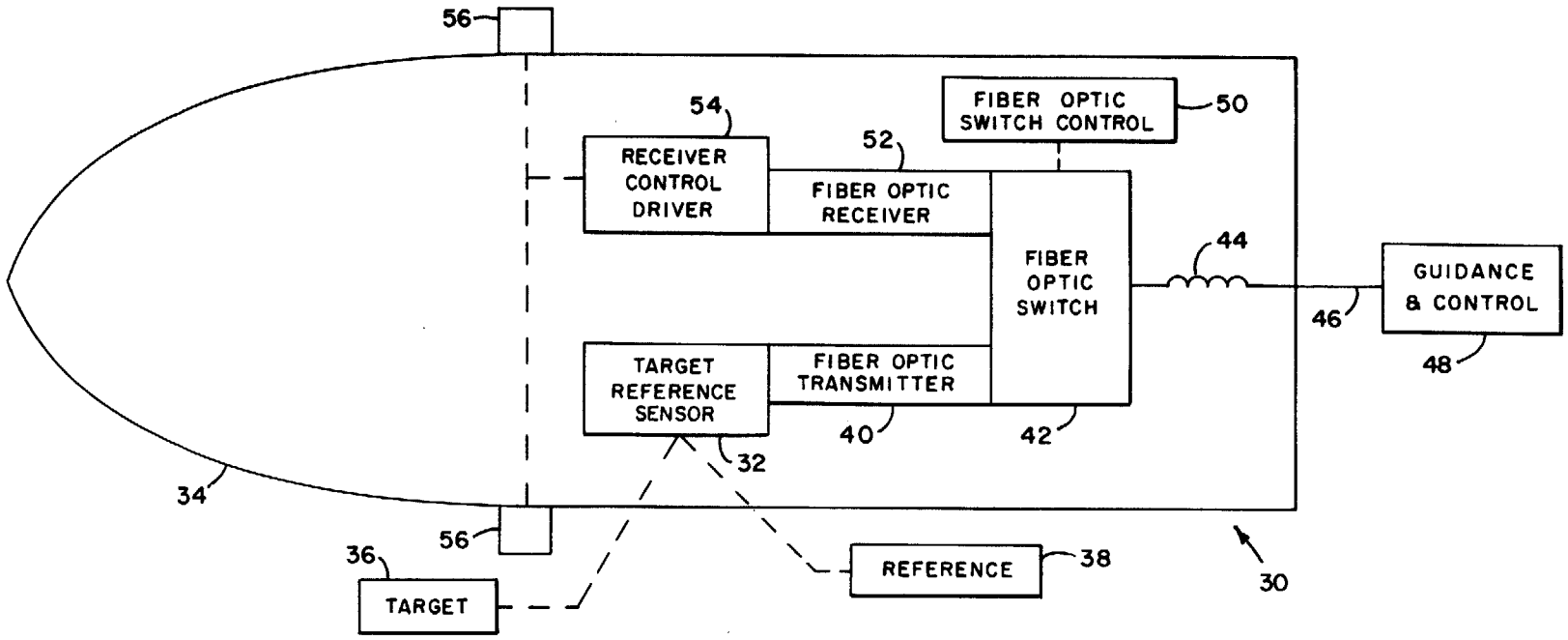
FIG. 2 is a diagrammatic view of a fiber optic guided missile with position sensing.

FIG. 2 shows a fiber optic guided missile system generally indicated as 30 with position sensing. In this system the fiber optic is used to control the missile in flight and also to establish the missile's position with respect to the target during flight. Reference numeral 32 indicates a target reference sensor that establishes the angular direction from a missile 34 to the target 36 and also to a reference 38. This information is passed to the fiber optic transmitter 40 through the fiber optic switch 42 through the fiber optic bobbin 44 through the fiber optic 46 to the guidance and control unit 48. The guidance and control unit 48 processes the information received into missile control information. A fiber optic switch control 50 controls the time sharing of switch 42 between the transmit and receive positions. The missile and control information processed by unit 48 is transmitted from the unit 48 through the fiber optic 46, fiber optic bobbin 44, switch 42 to fiber optic receiver 52. Receiver 52 passes the control information into a receiver control driver 54 where it is processed into control vane signals. These signals move the control vanes 56 to position the missile along the proper flight path.

I claim:

1. A fiber optic transmission system for guiding and controlling a missile in flight and to establish the missile position with respect to a target, said system comprising: target sensor means disposed in said missile for establishing the target angular direction in relation to said missile; fiber optic means carried by said missile for transmitting said target information from said missile, said fiber optic means including a fiber optic transmitter, a fiber optic switch, a fiber optic connection between said missile and said guidance and control unit, and a bobbin having said fiber optic conductor wound thereon; a guidance and control unit remote from said missile for receiving said target information and developing missile control information; and, means carried by said missile for receiving said control information and driving control vanes to position the missile along the proper flight path.

2. A fiber optic transmission system as set forth in claim 1 wherein said means carried by said missile for receiving the control information includes a fiber optic receiver and a fiber optic switch control for time sharing of the fiber optic switch between transmit and receive positions.

* * * * *